US005125989A

United States Patent [19]

Hallman

[11] Patent Number: 5,125,989

[45] Date of Patent: Jun. 30, 1992

[54] METHOD AND COMPOSITION FOR COATING ALUMINUM

[75] Inventor: Lydia Hallman, Phoenixville, Pa.

[73] Assignee: Henkel Corporation, Ambler, Pa.

[21] Appl. No.: 619,799

[22] Filed: Nov. 29, 1990

Related U.S. Application Data

[62] Division of Ser. No. 341,610, Apr. 21, 1989, Pat. No. 4,992,116.

[51] Int. Cl.[5] ..... C23C 22/36

[52] U.S. Cl. ..... 148/247

[58] Field of Search ..... 148/247, 251

[56] References Cited

U.S. PATENT DOCUMENTS 4,017,334 4/1977 Matsushima ..... 148/6.15 R 4,470,853 9/1984 Das ..... 148/6.15 R

FOREIGN PATENT DOCUMENTS 3900149 7/1989 Fed. Rep. of Germany .

2014617 2/1979 United Kingdom .

*Primary Examiner*—Sam Silverberg

*Attorney, Agent, or Firm*—Ernest G. Szoke; Wayne C. Jaeschke; Daniel S. Ortiz

[57] ABSTRACT

The invention is a composition and method for treating aluminum. The composition comprises phosphonic acid, fluorozirconic acid, fluorotitanic acid, fluorohafnic acid, or fluorosilicic acid and a Mannich adduct of an polyalkenyl phenol or tannin. The aluminum is treated by contact with the composition. An inorganic-organic conversion coating is applied to the aluminum in a single step.

8 Claims, No Drawings

METHOD AND COMPOSITION FOR COATING ALUMINUM

This is a divisional of application Ser. No. 07/341,610, filed on Apr. 21, 1989, now U.S. Pat. No. 4,992,116.

BACKGROUND OF THE INVENTION

1. Field of the Invention

The invention is a process for forming a coating on aluminum and a composition for use in the process. The coating composition comprises (a) phosphate ion, (b) an element selected from the group consisting of Zr, Ti, Hf, and Si based on fluorozirconic, fluorotitanic, fluorohafnic, and fluorosilicic acid and a polyphenol composition and water. The composition when contacted with clean aluminum forms an inorganic—organic conversion coating in one step.

2. Statement of Related Art

It is well known that the corrosion resistance and paint adhesion properties of an aluminum substrate can be improved by forming a chromate conversion coating on the substrate. The chromium containing coating is formed by contacting the substrate with an aqueous conversion coating composition containing hexavalent chromium ions, phosphate ions, and fluoride ions. In recent years, there has been a growing concern about pollution of the environment with toxic chemical materials. Hexavalent chromium can cause problems if discharged into waterways because of its strongly oxidizing character. As a result, conventional chromate conversion coating processes require extensive waste treatment procedures to eliminate possible harmful effects resulting from the discharge of hexavalent chromium. Treatment of the hexavalent chromium wastes results in increased costs and the difficulties with disposing of the waste solutions.

Chromium-free coatings for aluminum are known. U.S. Pat. No. 4,148,670 discloses an acidic aqueous conversion coating solution for aluminum which comprises zirconium or titanium, a phosphate ion, and available fluoride. These solutions are prepared generally from ammonium salts of fluorozirconic acid or fluorotitanic acid, phosphoric acid, and hydrogen fluoride. The solution is used to contact an aluminum substrate in a pH range of about 1.5 to about 4 and forms a conversion coating thereon.

British patent application 2,165,165 discloses a coating process for aluminum. The process comprises contacting a cleaned aluminum surface with an aqueous acidic treatment composition to form a coating thereon, rinsing the coated metal surface with water and contacting the rinsed metal surface with a post-treatment solution and drying the metal surface.

The aqueous acidic treatment conversion coating solution comprises dissolved metal ions selected from the group consisting of hafnium, zirconium, titanium and mixtures thereof, phosphate ions, fluoride ions, vegetable tannin compound and a sequestering agent. After contact with the acidic conversion coating solution, the aluminum surface is then rinsed and contacted with a solution of a Mannich adduct of polyalkenyl phenol. The process is a three-step process and requires considerable manipulation of the aluminum being coated.

U.S. Pat. No. 4,191,596 discloses a method and composition for coating aluminum. Aluminum is coated by contacting a clean aluminum substrate with a mixture consisting essentially of (a) polyacrylic acid or esters thereof and, (b) at least one acid selected from the group consisting of fluorozirconic, fluorotitanic and fluorosilicic acids. The coating process is a single step process and is essentially chromium and phosphate-free. The composition has achieved commercial success.

U.S. Pat. No. 4,136,073 discloses a process for treating aluminum by contacting the aluminum with an acid composition consisting essentially of a stable organic film forming polymer and a soluble titanium compound. The film forming polymer exemplified is a polyacrylic ester. Fluoride and phosphate are not critical to the composition. One treating composition exemplified contains fluoride and phosphate, the treating composition of Example 2 does not disclose phosphate as a component.

In view of the difficulties associated with using chromium conversion coatings, it is desirable to have a non-chromium conversion coating which provides an organic finish coated aluminum with paint adhesion and corrosion resistance, substantially equivalent to organic finish coated chromate treated aluminum. It would be desirable to achieve the aluminum coating in a single step.

BRIEF DESCRIPTION OF THE INVENTION

Other than in the operating examples and claims, or where otherwise indicated, all numbers expressing quantities of ingredients or reaction conditions used herein are to be understood as modified in all instances by the term "about".

The invention provides a coating composition for aluminum and alloys of aluminum in which aluminum is the principal constituent. The coating composition comprises: an aqueous acidic solution (a) of from about $1.1\times10^{-5}$ to about $5.4\times10^{-3}$ mols per liter of $PO_4^{-3}$, (b) from about $1.1\times10^{-5}$ to about $1.3\times10^{-3}$ mols per liter of a component containing an element selected from the group consisting of Zr, Ti, Hf, and Si based on fluorozirconic, fluorotitanic, fluorohafnic, and fluorosilicic acid, (c) from about 0.26 to about 20 grams per liter of a polyphenol composition and (d) water, wherein the pH of the coating composition is from about 2.5 to about 5.0, and the mol ratio of the element to $PO_4^{-3}$ is from about 2.5:1 to about 1:10. The aluminum substrate to be coated is contacted with the coating composition for a period of from about 5 to about 300 seconds, rinsed and dried and can be coated with an organic finish coating.

The invention comprises a concentrate of the coating composition and a process for treating aluminum.

DETAILED DESCRIPTION OF THE INVENTION

The composition of the invention comprises from about $1.1\times10^{-5}$ to about $5.3\times10^{-3}$ mols per liter of $PO_4^{-3}$ and preferably from about $3\times10^{-4}$ to about $1.1\times10^{-3}$ mols per liter.

The metal elements used in the composition of the present invention are selected from zirconium, titanium, hafnium, and silicon. The elements are preferably added to the aqueous composition in the form of the fluorozirconic, fluorotitanic, fluorohafnic, or fluorosilicic acid. The element containing compositions can be added to the mixture in the form of the tetrafluoride and hydrogen fluoride or as an alkali metal or ammonium salt in combination with a sufficient amount of nitric acid to provide the required pH. However, the addition of fluorozirconic, fluorotitanic, fluorohafnic, or fluorosilicic acid to the mixture is preferred. A small amount of HF can be added to the mixture to provide additional fluoride ion but preferably not more than 1 mol per mol of fluoroacid or fluoroacid equivalent.

The other critical material in the composition of the present invention is a polyphenol composition. As used herein a polyphenol composition refers to a Mannich adduct of an amine to a polyalkenyl phenol or a tannin. The polyphenol compositions useful in the practice of the present invention are well known in the art. The Mannich adducts of polyalkenyl-phenols are disclosed in U.S. Pat. Nos. 4,517,028, 4,457,790, 4,433,015, U.S. application Ser. No. 07/128,673, U.S. application Ser. No. 07/272,172 and U.S. application Ser. No. 07/128,756. The contents of the patents and applications are expressly incorporated herein by reference.

In general, the polyphenol compositions useful in the practice of the present invention are polymers and copolymers of the structure

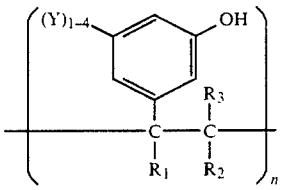

wherein $R_1$ through $R_3$ are hydrogen or an alkyl group having from about 1 to 5 carbon atoms; each Y is independently hydrogen, Z, $CR_4R_5OR_6$, $CH_2Cl$ or an alkyl or aryl group having from about 1 to 18 carbon atoms. Z is

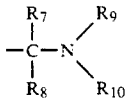

wherein $R_4$ through $R_{10}$ are hydrogen, an alkyl, aryl, hydroxyalkyl, amino-alkyl, mercapto-alkyl, or a phospho-alkyl moiety. The $R_4$ through $R_{10}$ moieties can have carbon chain lengths up to a length at which the compound is not soluble or dispersible in water. In the formula, n is a number from 2 to a number at which the polymer becomes insoluble or not dispersible.

The polyphenol composition can be a homopolymer or a copolymer of substituted vinylphenols, substituted propenylphenols, substituted butenylphenols, and the like. The polyphenol compositions must have at least a sufficient amount of Z moieties to be water soluble.

The Z moieties are formed by the Mannich reaction of alkenyl phenols which can be later polymerized or polyalkenyl-phenols with formaldehyde and an amine. Compositions having an average of from about 0.5 to about 1.5 Z groups per monomer unit in the polyphenol composition are generally useful. Preferably, the composition has an average of from about 0.6 to about 1.2 Z group per phenol unit.

The hydrogen of the phenol group can be substituted by an acyl moiety, acetyl moiety, a benzyl moiety, an alkyl moiety, benzyl moiety, haloalkyl, haloalkenyl, an alkali metal, tetraorganoammonium, tetraorganophosphonium composition, or a condensation product of ethylene oxide, propylene oxide, or a mixture thereof.

The preferred Z group is the Mannich adduct of a polyhydroxy-alkylamine which is prepared by the condensation of an amine or ammonia and a ketose or aldose. Other alkylaminopolyhydroxy compounds having from about 3 to 8 carbon atoms can be used to prepare the polyphenol composition. Preferably, the Z group is formed by the Mannich reaction of formaldehyde and N-methylglucamine. The degree of substitution is preferably from an average of about 0.5 to about 1.5 glucamine adduct units per phenol group and most preferably from about 0.6 to about 1 glucamine adduct unit per phenol group.

The polyphenol compositions comprise at least two phenol groups and preferably from about 10 to about 850 phenol groups, and more preferably from about 15 to about 300 phenol groups.

The polyphenol compositions useful in the practice of the present invention also encompass the Mannich adducts of tannin compositions. Tannins are complex natural products which contain polyphenol. The Mannich adducts of the tannins are prepared in a manner similar to the preparation of the Mannich adducts of the polyphenol compositions which are disclosed in the published patents. The glucamine-formaldehyde adduct is prefered.

The polyphenol compositions are prepared by heating a polyalkenyl phenol or alkenyl phenol in a solvent to dissolve the composition. The amine is added. Formaldehyde solution is slowly added to the mixture of the polyalkenyl phenol and amine. The reaction mixture is maintained at a temperature in the range of about 30° to about 100° C. for from about 2 to about 8 hours to complete the reaction. The Mannich adduct of the polyalkenyl phenol or alkenyl phenol is generally at an alkaline pH and can be neutralized by the addition of an acid.

In the present invention, fluorozirconic, fluorotitanic, fluorohafnic, or fluorosilicic acids and the phosphoric acid can be added to reduce the pH. If the addition of the fluoroacid and the phosphoric acid does not reduce the pH to the desired range of from about 2.5 to about 5.0, the pH can be further reduced by the addition of acids such as nitric acid, or minor amounts of hydrogen fluoride.

The process of the present invention in general comprises contacting a clean aluminum substrate with the composition of the present invention. The aluminum substrate must be clean. The aluminum can be cleaned with available commercial acid or alkaline cleaners. It is preferred that the aluminum be cleaned with a low etching cleaner. Preferably a low etch dilute sulfuric acid containing composition is utilized.

The cleaned aluminum substrate is then rinsed to prevent contamination of the treating bath with the cleaning composition.

The aluminum substrates are then contacted with the coating composition comprising a fluoroacid at a concentration in the range of from about $1.1\times10^{-5}$ to $1.3\times10^{-3}$ mols per liter, a phosphate ion concentration in the range of about $1.1\times10^{-5}$ to about $5.3\times10^{-3}$ mols per liter wherein the ratio of fluoroacid to phosphate ion is in the range of from about 2.5:1 to about 1:10.

The polyphenol composition is present in the composition in a range of from about 0.26 grams per liter to about 20 grams per liter.

The pH of the coating composition can be adjusted to the desired range by addition of nitric acid. Other acids which do not react with the bath or form a precipitate can be used. The preferred acid is nitric. Generally from about 80 to about 200 parts per million of nitrate ion is present in the composition. As the composition is utilized, aluminum ions and small amounts of aluminum alloy element ions become dissolved in the composition.

The coating composition as set forth contains complex fluoroacid metal ions, phosphate ions, and the polyphenol composition. However, the fluoroacid metal complexes useful in the invention are associated with about 6 fluoride moieties per metallic or semi-metallic element. The fluoride moieties are important to the present invention and must be present. Generally, the concentration of fluoride moieties is in the range of from about 5 to about 7 fluoride moieties per metal or semi-metal element. The metallic or semi-metallic elements are added to the bath preferably in the form of the fluoroacids. Acids such as fluorozirconic, fluorotitanic, fluorohafnic, and fluorosilicic preferably utilized to prepare the bath. The use of the fluoroacids of the elements is preferred since they act as a neutralizing agent for the polyphenol composition and reduce the amount of acid addition required to adjust the pH to the required range. The alkali metal and ammonium salts of the fluoroacids can be utilized in the process.

The pH of the composition is in the range of from about 2.5 to about 5.0, and preferably in the range of 3 to 4. The desired pH range depends upon the particular element in the fluoroacid. Generally, titanium is used at a slightly lower pH than zirconium.

The aluminum substrate is contacted with the composition of the invention at a temperature in the range of from about ambient to about 190° F., preferably at a temperature in the range of from about 100° to 150° F. Generally, higher temperatures reduce the contact time between the aluminum substrate and the composition of the invention.

The aluminum substrate is generally contacted with the composition of the invention for from about 5 seconds to about 5 minutes, preferably from about 10 seconds to 60 seconds for spray application. Dipping applications generally require longer contact times. The composition of the present invention can be applied to the aluminum substrate by known methods for contacting aluminum substrates with treating compositions. For example, the aluminum substrte can be sprayed, dipped, flow-coated, roller-coated, and contacted with the composition by other methods known for contacting metal substrates with treating solutions. The important criterion is that the aluminum substrate be thoroughly contacted with the composition of the invention. Spray coating is the preferred method of contacting the aluminum substrate with the composition of the invention.

After contacting the aluminum with the coating composition of the invention, the coated aluminum substrates are rinsed to remove unattached coating composition. The present invention produces an inorganic-organic conversion coating in a one step process. A one step process has many advantages over a multistep process.

The coated aluminum substrates are then dried. It has been found that the coated substrates have better properties of corrosion resistance and organic coating adhesion when the drying is carried out slowly. The coated aluminum substrates can be dried at temperatures in the range of ambient to about 200° F. At temperatures above about 250° F., the corrosion resistance and paint adhesion of the coated aluminum substrate is reduced.

After drying the aluminum substrate is then coated with an organic finish coating with known organic coating materials suitable for coating aluminum substrates. It is well known that organic finish coated aluminum substrates are generally heated to remove solvents and to set the organic coating film. The heating associated with the final organic finish coat does not adversely affect the adhesion and corrosion resistance of the coating of the present invention. The aluminum substrates coated with the organic finish coating can be heated to temperatures in the range of 425° to 450° F. without adversely affecting the adhesion or the corrosion resistance of the coatings.

Applicants have discovered that organic coatings applied over aluminum substrates treated with the composition of the present invention can meet AAMA specifications 605.2 and 603.8. It was believed that only organic coatings applied over chromium treated aluminum substrates could meet these stringent specifications. Treating an aluminum substrate with the composition of the present invention provides organic finish coatings on the aluminum substrates which have properties similar to organic finish coatings on aluminum substrates with coatings containing chromium.

In the Examples for comparison purposes, aluminum substrates were cleaned then treated with commercially available compositions for treating aluminum substrates before coating with organic finish coatings. The organic finish coated aluminum substrates treated according to the present invention showed properties equivalent to organic finish coated chromium treated aluminum substrates.

In the experiments which follow, the organic finish coated specimens were tested according to the boiling water cross-hatch test, the wet-adhesion test, the detergency test, the 1,000 hour neutral salt spray test, the dry adhesion test, the mortar and muriatic acid resistance tests and humidity tests. The tests were carried out according to AAMA 603.8 and AAMA 605.2.

In the boiling water cross-hatch test, the organic finish coated substrates were scribed in a pattern of eleven parallel lines with eleven parallel lines at right angles to the first group. The scribed lines were at 1/16 inch intervals. The scribed cross-hatched substrates were then placed in boiling distilled deionized water for a period of 20 minutes. The test specimens were removed from the water, dried and a piece of transparent tape (3M No. 710, ¾ inch wide) was placed over the cross-hatched area, the tape pressed to remove air bubbles and to ensure adhesion to the film, then the tape was pulled off sharply at a 90° angle to the surface of the substrate. The number of unaffected squares was noted and the rating made.

The wet-adhesion test was carried out by making eleven parallel cuts, one/sixteenth inch apart, through the film. Eleven similar cuts at 90° to and crossing the first eleven cuts were made. The sample was immersed in deionized water at 100° F. for 24 hours. The sample was removed, and wiped dry. Transparent tape (3M No. 710, ¾ inch wide) was applied over the area of the cuts by pressing down firmly against the coating to eliminate voids and air pockets. The tape was sharply pulled off at a right angle to the plane of the surface. Satisfactory performance was that no removal of film under the tape within the cross-hatched area was noted.

The detergency test was carried out by immersing test specimens in a 3% by weight detergent solution at 100° F. for 72 hours. The sample was removed from the detergent solution and wiped dry. Transparent tape (3M transparent no. 710 tape, ¾ inch wide) was applied over the organic finish film and pressed down to eliminate voids and air pockets. The tape was sharply pulled off at a right angle to the plane of the surface.

The detergent composition was as follows:

| | |
|---|---|
| Tetrasodium pyrophosphate | 45% |
| Sodium sulfate, anhydrous | 23% |
| Sodium alkylaryl sulfonate | 22% |
| Sodium metasilicate, hydrated | 8% |
| Sodium carbonate, anhydrous | 2% |

Passing of the test requires no loss of adhesion of film to metal, no blistering and no visual change in appearance when examined by an unaided eye.

The salt spray test was carried out according to ASTM specification B117 and Federal test method standard 151B, method 811.1 and Federal test method standard 141, method 6061. The organic finish coated aluminum substrates were scribed and placed in the salt spray cabinet for the 1,000 hours.

The dry adhesion, mortar resistance, muriatic acid resistance and humidity test were run according to AAMA 603.8 and 605.2.

The aluminum substrates to be coated were first cleaned with a low etch acid or low etch alkaline cleaning composition. Substantially no difference was noted in the specimens which were cleaned with the low etch acid or low etch alkaline cleaning compositions. Since low etch acid cleaners are particularly effective in a commercial installation, low etch acid cleaning compositions are preferred.

The clean substrates were then coated with commercial aluminum coating compositions, according to the manufacturer's recommendations and the treated aluminum substrates were dried and coated with an organic finish coating. The organic finish coated aluminum substrates were then subjected to the tests the results of which are shown in Table 1.

EXAMPLE 1

A Mannich adduct of polyvinyl phenol was prepared. Resin M (a polyvinyl phenol) with an average molecular weight of 5000, a product of Maruzen Oil Company, in an amount of 24.6 parts was dissolved in 54.4 parts of Propasol ® P (a propoxylated propane solvent obtained from Union Carbide Corp.). The mixture was mildly heated to dissolve the resin. To the resin in Propasol ® P was added 40.4 parts of N-methyl glucamine. The mixture was heated to a temperature in the range of 60°-65° C. A 37% solution of formaldehyde in water, in an amount of 16.6 parts, was added to the mixture over a period of about 1½ hours. The temperature was then raised to about 90° C. and held for six hours. The reaction mixture was diluted to about 10% solids with deionized water. The mixture contained an N-methylglucamine Mannich adduct of polyvinylphenol. To the mixture was added 9 parts of a 45% $H_2ZrF_6$ solution, 4.8 parts of a 75% $H_3PO_4$ solution and 10.7 parts of 42° Be nitric acid. The total water content of the mixture was adjusted to 839.5 parts. The composition is a concentrate which is diluted to form the aluminum treating composition.

The aluminum substrate was cleaned with RIDOLINE ® 336 (20 grams/liter) by spraying at 10 psi at 140° F. for 45 seconds. RIDOLINE ® 336 is a an alkaline borate cleaning composition for aluminum, a product of Parker+Amchem, a subsidiary of Henkel Corporation.

The cleaned aluminum substrate was rinsed with tap water at ambient temperature.

The rinsed aluminum substrate was then contacted with a 2% solution of the concentrate in deionized water for 45 seconds by spraying at 10 psi and 120° F. The treated aluminum substrate was then rinsed with tap water at ambient temperature and given a second rinse with deionized water at ambient temperature. The aluminum substrate was then air dried and painted with an organic finish coat. The organic finish coat was cured by heating at 400° F. for 10 minutes.

Aluminum substrates of the same composition as treated with the composition of the present invention were cleaned with RIDOLINE ® 336 and coated with commercial aluminum treating compositions as shown in the Table. The treatments were done according to the manufacturer's recommendation. The results of the various tests are set forth in Table 1.

An alkaline cleaning composition was utilized for the comparison tests since some of the aluminum treating compositions utilized in the tests require cleaning with an alkaline cleaner. In addition, many commercial operations include equipment for alkaline cleaning.

In Table 1, the results of the tests of 2 test specimens are set forth.

Table 2 presents a comparison of the best non-chrome aluminum treatment with the treatment according to the present invention.

TABLE I

Treatment Comparisons
Alloy: Aluminum 6063 Extrusions
Paint: PPG Quaker High Solids Bronze

| Code | Treatment | Boiling Water Crosshatch[1] | Wet Adhesion | Detergency Test | 1000 Hour Neutral Salt Spray Scribe | 1000 Hour Neutral Salt Spray Field |
|---|---|---|---|---|---|---|
| TT2 | Bonderite ® 798 | 9/8 | S | U | 4.0 | 8.0 |
| TT2 | Bonderite ® 798 | 2/4 | S | U | 4.5 | 9.0 |
| TT4 | Alodine ®-404 | 10/5 | U | U | 3.0 | 8.0 |
| TT4 | Alodine ®-404 | 2/0 | S | U | 3.0 | 7.0 |
| TT5 | Alodine ®-407/47 | 10/10 | S | S | 10 | 10 |
| TT5 | Alodine ®-407/47 | 10/10 | S | S | 10 | 10 |
| HH5 | Alodine ®-4830/31 | 9.5/9.5 | S | S | 10 | 8 |
| HH5 | Alodine ®-4830/31 | 9.5/9.5 | S | S | 10 | 8 |
| AP3 | Present invention Example 1 | 10/10 | S | S | 10 | 10 |
| AP3 | Present | 10/10 | S | S | 10 | 10 |

TABLE I-continued

| Treatment Comparisons Alloy: Aluminum 6063 Extrusions Paint: PPG Quaker High Solids Bronze | | | | | | |
|---|---|---|---|---|---|---|
| | | | | | 1000 Hour Neutral Salt Spray | |
| Code | Treatment | Boiling Water Crosshatch[1] | Wet Adhesion | Detergency Test | Scribe | Field |
| | invention Example 1 | | | | | |

All of the above processes produce satisfactory results on dry adhesion mortar, acid and humidity testing.
Note:
Bonderite 798 - a zirconium phosphate conversion coating, a product of Parker + Amchem.
Alodine-404 - a zirconium phosphate conversion coating, a product of Parker + Amchem.
Alodine-407/47 - a chromium phosphate conversion coating, a product of Parker + Amchem.
Alodine-4830/31 - a fluorozirconic acid polyacrylic acid composition according to U.S. Pat. No. 4,191,596, a product of Parker + Amchem.
[1]Test results on different ends of the same piece.

TABLE II

| Treatment Comparison Different Paint Systems Alloy: Aluminum 6061-T6 Panel Stock | | | | | | | |
|---|---|---|---|---|---|---|---|
| | | | | | | 1000 Hour. Neutral Salt Spray | |
| Paint System | Treatment | Code | Boiling Water Crosshatch | 72 hour Detergency | Wet/Dry Adhesion | Scribe | Field |
| Enmar Bronze (609-711) | Alodine ®-4830/31 | 1A | 9.5/9.5 | S/S | — | 10/10 | 7/4 |
| Enmar Bronze (609-711) | Present invention Example 1 | 2A | 9.5/9.5 | S/S | — | 10/9 | 10/10 |
| Piedmont Beige (8948) | Alodine ®-4830/31 | B1 | 8/8 | S/S | — | 9/4 | 7.5/6.5 |
| Piedmont Biege (8948) | Present invention Example 1 | B1A | 9.5/9.5 | S/S | — | 10/4 | 10/10 |
| Piedmont Grey (8923) | Alodine ®-4830/31 | B2A | 9.5/9.5 | S/S | — | 9/4 | 6/4.5 |
| Piedmont Grey (8923) | Present invention Example 1 | B2A | 9.5/9.5 | S/S | — | 10/4 | 6/6 |
| Sherwin Williams PermaClad-White | Alodine ®-4830/31 | 2 | 10/10 | S/S | S/S | 8/10 | 10/10 |
| Sherwin Williams PermaClad-White | Present invention Example 1 | 3 | 10/10 | S/S | S/S | 9/10 | 10/10 |
| Sherwin Williams PermaClad-Bronze | Alodine ® 4830/31 | 2 | 8/8 | S/S | 10/10 | 4/7 | 10/10 |
| Sherwin Williams PermaClad-Bronze | Present invention Example 1 | 3 | 10/10 | S/S | 10/10 | 3/7 | 10/10 |

The Examples presented in Table 1 and Table 2 clearly show that aluminum substrates, which are treated according to the process of the present invention, provide organic finish coated aluminum substrates with adhesion and corrosion resistance properties similar to those obtained by the use of chromium containing conversion coatings. In addition, the treatment of the present invention provides aluminum coatings superior to the known fluorozirconic acid polyacrylic acid composition. The composition and the process of the present invention is an advance in the art and permits a substantial reduction in the use of toxic materials and potential pollution of the environment.

EXAMPLE II

A concentrate was prepared by mixing a polyphenol composition in water and Proposal ® P with fluorotitanic acid and phosphoric acid. The concentrate was diluted with deionized water to form a coating composition containing:

| | |
|---|---|
| $H_2TiF_6$ | $1.07 \times 10^{-3}$ mols/liter |
| $H_3PO_4$ | $2.08 \times 10^{-3}$ mols/liter |
| polyphenol composition | 0.78 grams/liter |
| deionized water | to one liter. |

The polyphenol composition was a Mannich adduct of polyvinylphenol with N-methylglucamine and formaldehyde prepared by a method similar to the method of Example 1. The polyvinyl phenol was Resin M from Maruzen Oil Co. having a molecular weight of about 5,000. About 60% of the phenol groups were substituted with the adduct.

The aluminum substrate was alloy 6063. The aluminum substrate was cleaned with a low etch sulfuric acid cleaner, rinsed with tapwater then contacted with the coating composition by spraying for 45 seconds at 10 psi and 120° F. The treated aluminum substrate was rinsed once with tap water and once with deionized water and dried at ambient temperature. The dried substrate was coated with PPG Quaker High Solids Bronze paint, the paint was cured at 400° F. for 10 minutes and the coated aluminum substrate tested according to AAMA 603.8 and 605.2.

The test results were as follows:

| Code | Boiling Water Crosshatch | Wet Adhesion | Detergency Test | 1000 Hour Neutral Salt- Scribe | Field |
|---|---|---|---|---|---|
| MM2 | 10/10 | S | S | 10 | 10 |
| MM2 | 10/10 | S | S | 9.8 | 10 |

| Code | Wet Adhesion | Mortar Test | Acid Test | Humidity |
|---|---|---|---|---|
| MM2 | S | S | S | 10 |
| MM2 | S | S | S | 10 |

Aluminum substrates were cleaned with a low etch sulfuric acid cleaner, rinsed and treated with the composition of Example 1 according to the procedures of Example 1.

Aluminum substrates cleaned with the same low etch sulfuric acid cleaner were rinsed; treated according to manufacturers recommendations with a chromium phosphate conversion coating (ALODINE 407/47, a product of Parker+Amchem, a subsidiary of Henkel Corp.).

The treated aluminum substrates were dried and coated with PPG Quaker High Solids Bronze organic finish coating and heated to 400° F. for 10 minutes to cure the coating.

The organic finish coated substrates were tested according to AAMA 603.8 and 605.2 test procedures. The results of the tests are shown in Table III.

TABLE III

| Code | Cleaner | Treatment | Boiling Water Crosshatch | Dry Adhesion | Wet Adhesion | Mortar Test | Muriatic Acid Test | Detergency Test | 1000 Hour Neutral Salt Spray Scribe | Field | Humidity (1000 Hrs) |
|---|---|---|---|---|---|---|---|---|---|---|---|
| | | | Alloy: Aluminum 6063 Extrusion Stock Paint: PPG Quaker High Solids Bronze | | | | | | | | |
| AP3 | Sulfuric acid | present invention Example 1 | 10/10 | 10 | 10 | S | S | S | 10 | 10 | 10 |
| AP3 | Sulfuric acid | present invention Example 1 | 10/10 | 10 | 10 | S | S | S | 10 | 10 | 10 |
| AK3 | Sulfuric acid | Alodine ® 407/47 | 10/10 | 10 | 10 | S | S | S | 10 | 10 | 10 |
| AK3 | Sulfuric acid | Alodine ® 407/47 | 10/10 | 10 | 10 | S | S | S | 10 | 10 | 10 |

I claim:

1. A process for preparing an aluminum substrate for receiving an organic finish coating which comprises: contacting a clean aluminum substrate with a coating composition comprising (a) from about $1.1\times10^{-5}$ to about $5.3\times10^{-3}$ mols per liter of $PO_4^{-3}$; (b) from about $1.1\times10^{-5}$ to about $1.3\times10^{-3}$ mols per liter of a fluoroacid of an element selected from the group consisting of Zr, Ti, Hf, and Si; (c) from about 0.26 to about 20 grams liter of a polyphenol composition, the polyphenol composition comprising a Mannich Adduct of an amine to a member selected from the group consisting of polyalkenyl-phenols and tannins; and (d) water, wherein the pH of the coating composition is from about 2.5 to about 5.0, the mol ratio of fluoroacid to $PO_4^{-3}$ is from about 2.5:1 to about 1:10 at a temperature in the range of from about ambient to 200° F. for a time sufficient to form an adherent coating for accepting the organic finish coating.

2. A process of claim 1 wherein the coating composition contains $NO_3^-$.

3. A process of claim 1 wherein the coating composition contains: (a) from about $3.0\times10^{-4}$ to about $1.1\times10^{-3}$ mols per liter of $PO_4^{-3}$; (B) from about $3\times10^{-4}$ to about $7.2\times10^{-4}$ mols per liter of fluoroacid; (c) and from about 0.40 to about 20 grams per liter of the polyphenol composition, the polyphenol composition comprising a Mannich Adduct of an amine to a member selected from the group consisting of polyalkenylphenols and tannins' and (d) water; the mol ratio of fluoroacid to $PO_4^{-3}$ is from about 1:1 to about 1:25 and the pH is from about 3 to about 4.

4. A process of claim 3 wherein the composition contains $NO_3^-$ and the fluoroacid is fluorozirconic acid.

5. A process of claim 1 wherein the aluminum substrate after contacting the composition is rinsed, and dried before receiving the organic finish coating.

6. A process of claim 1 wherein the aluminum is cleaned by contact with a low etch alkaline cleaning composition.

7. A process of claim 1 wherein the aluminum is cleaned by contact with a low etch acid cleaning composition.

8. A process of claim 5 wherein the aluminum substrate is dried at a temperature in the range of from about ambient to about 150° F.

* * * * *